US007004286B2

(12) United States Patent
Fredette

(10) Patent No.: US 7,004,286 B2
(45) Date of Patent: Feb. 28, 2006

(54) MOTORIZED SCAFFOLD WITH DISPLACEABLE WORKER SUPPORT PLATFORM

(76) Inventor: Jean-Paul Fredette, 280 Mogé, Sorel-Tracy (CA) J3P 6X2

( * ) Notice: Subject to any disclaimer, the term of this patent is extended or adjusted under 35 U.S.C. 154(b) by 47 days.

(21) Appl. No.: 10/663,795

(22) Filed: Sep. 17, 2003

(65) Prior Publication Data

US 2005/0056484 A1 Mar. 17, 2005

(51) Int. Cl.
*E04G 1/00* (2006.01)

(52) U.S. Cl. ..... 182/62.5; 182/63.1

(58) Field of Classification Search ..... 182/62.5, 182/63.1, 69.1–69.6
See application file for complete search history.

(56) References Cited

U.S. PATENT DOCUMENTS 1,092,096 A * 3/1914 Donigan ..... 182/62.5
1,531,982 A * 3/1925 Sago ..... 182/41
1,708,113 A * 4/1929 Allen ..... 182/62.5
3,031,027 A * 4/1962 Mitchell ..... 182/69.4
3,566,991 A * 3/1971 Proulx ..... 182/129
3,610,368 A * 10/1971 Johnson ..... 182/146
3,785,454 A 1/1974 Behunin et al.
5,381,872 A * 1/1995 Peruzzi et al. ..... 182/63.1
5,582,467 A * 12/1996 Drolet et al. ..... 299/33
6,339,917 B1 * 1/2002 Dillon et al. ..... 56/14.6
6,349,793 B1 2/2002 Kincaid

* cited by examiner

*Primary Examiner*—Alvin Chin-Shue
(74) *Attorney, Agent, or Firm*—Ogilvy Renault LLP; Guy J. Houle

(57) ABSTRACT

A motorized scaffold for self-displacement on land is comprised of a support base mounted on a pair of traction belts. Jacks are provided to immobilize and level the support base at a desired location. A platform assembly is secured over the support base on extendable supports. Braces are secured between the support base and the platform assembly and are extendable with the movement of the platform assembly over the base whereby to maintain the platform assembly substantially stable during its displacement and at a stationary desired working elevation with respect to the support base. A displaceable worker support platform is secured to the platform assembly for supporting workers thereon.

22 Claims, 11 Drawing Sheets

92
12
11
71
93
70
93
91
66
71
94
31
90
67
62
75
61
26
72
27
27
28
29
28

27
28
28
27
29
25
26
13
24
24
56
17
14
57
14

MOTORIZED SCAFFOLD WITH DISPLACEABLE WORKER SUPPORT PLATFORM

TECHNICAL FIELD

The present invention relates to a motorized scaffold with a displaceable platform assembly having a telescoping support platform and wherein displaceable bracing cables are provided to maintain the platform assembly substantially stable during its displacement and when at a stationary desired working elevation.

BACKGROUND ART

Motorized scaffolds are known in the art and such is exemplified, for example, by U.S. Pat. Nos. 3,785,454 and 6,349,793. There are several problems associated with known motorized scaffolds as such are fairly heavy and bulky apparatus. Accordingly, with these known scaffolds it is difficult to position them in restrained spaces and they are primarily limited for use adjacent to large building structures that are easily accessible. They are not made for displacement on irregular terrain as we find on construction sites where the terrain is not level. Also, most of these scaffolds are supported on wheels and therefore due to its heavy load they are not practical for use on soft, muddy terrain.

The motorized scaffold as described in U.S. Pat. No. 3,785,454 uses stationary tracks and accordingly it is feasible for use at a predetermined location such as inside a plant as tracks needs to be installed on prepared surfaces. The wheels are also adapted for placement on such tracks and at specific locations along the tracks. The structure as described in U.S. Pat. No. 6,349,793 is also feasible for use on a flat ground surface as it is necessary to maintain the vehicle substantially horizontal. If the working platform is to be raised in a vertical plane adjacent a building structure or other structure where workers need side access thereto, then the land has to be leveled. Such a structure is also unstable if large working materials were to be placed at one end of the working platform making the platform imbalanced. Furthermore, such motorized lifting apparatus is not feasible for working in narrow restrained areas between buildings if such areas are narrower than the width of the platform and support vehicle. Still further, with these prior art scaffolds it is necessary to displace the scaffold each time work is completed adjacent the scaffold as these are not laterally extendable. Therefore, the motorized part of the scaffold needs to be moved each time the working platform needs to be displaced.

SUMMARY OF INVENTION

It is the feature of the present invention to provide a motorized scaffold having a displaceable worker support platform and which substantially overcomes the above-mentioned disadvantages of the prior art.

Another feature of the present invention is to provide a motorized scaffold having a displaceable worker support platform which is extendable forwardly and laterally of a platform assembly to permit workers to work away from the platform assembly and in restrained spaces.

Another feature of the present invention is to provide a motorized scaffold capable of being displaced on irregular surfaces and soft surfaces and wherein the support platform can be leveled and extended from the motorized support base thereof.

Another feature of the present invention is to provide a motorized scaffold with a displaceable worker support platform and wherein a platform assembly is displaceable over a support base and interconnected with the support base by bracing means to provide stability and counter-leverage of the platform assembly and displaceable worker support platform which is extendable laterally of the platform assembly.

Another feature of the present invention is to provide a motorized scaffold with a displaceable worker support platform and wherein the platform is capable of supporting workers, working material and working machinery in a safe and efficient manner.

Another feature of the present invention is to provide a motorized scaffold having a displaceable worker support platform which permits workers to work along large surface areas extending beyond the motorized support base of the scaffold thereby avoiding to displace the support base when work needs to be done exteriorly of the platform assembly.

Another feature of the present invention is to provide a motorized scaffold with a displaceable worker support platform and wherein the scaffold is supported on traction means capable of displacing the motorized support base on soft ground surfaces or snow covered surfaces.

Another feature of the present invention is to provide a motorized scaffold having a motorized support base provided with hydraulic jacks capable of mobilizing and leveling the support base at a desired location.

According to the above features, from a broad aspect, the present invention provides a motorized scaffold for self-displacement on land. The scaffold comprises a motorized support base mounted on traction means for displacement on land. Means is provided to immobilize and level the support base at a desired location. A platform assembly is secured over the support base on extendable support means. Displaceable bracing means is secured between the support base and the platform assembly to maintain the platform assembly substantially stable during displacement thereof and at a desired stationary working elevation with respect to the support base. A displaceable worker support platform is secured to the platform assembly for supporting workers thereon.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
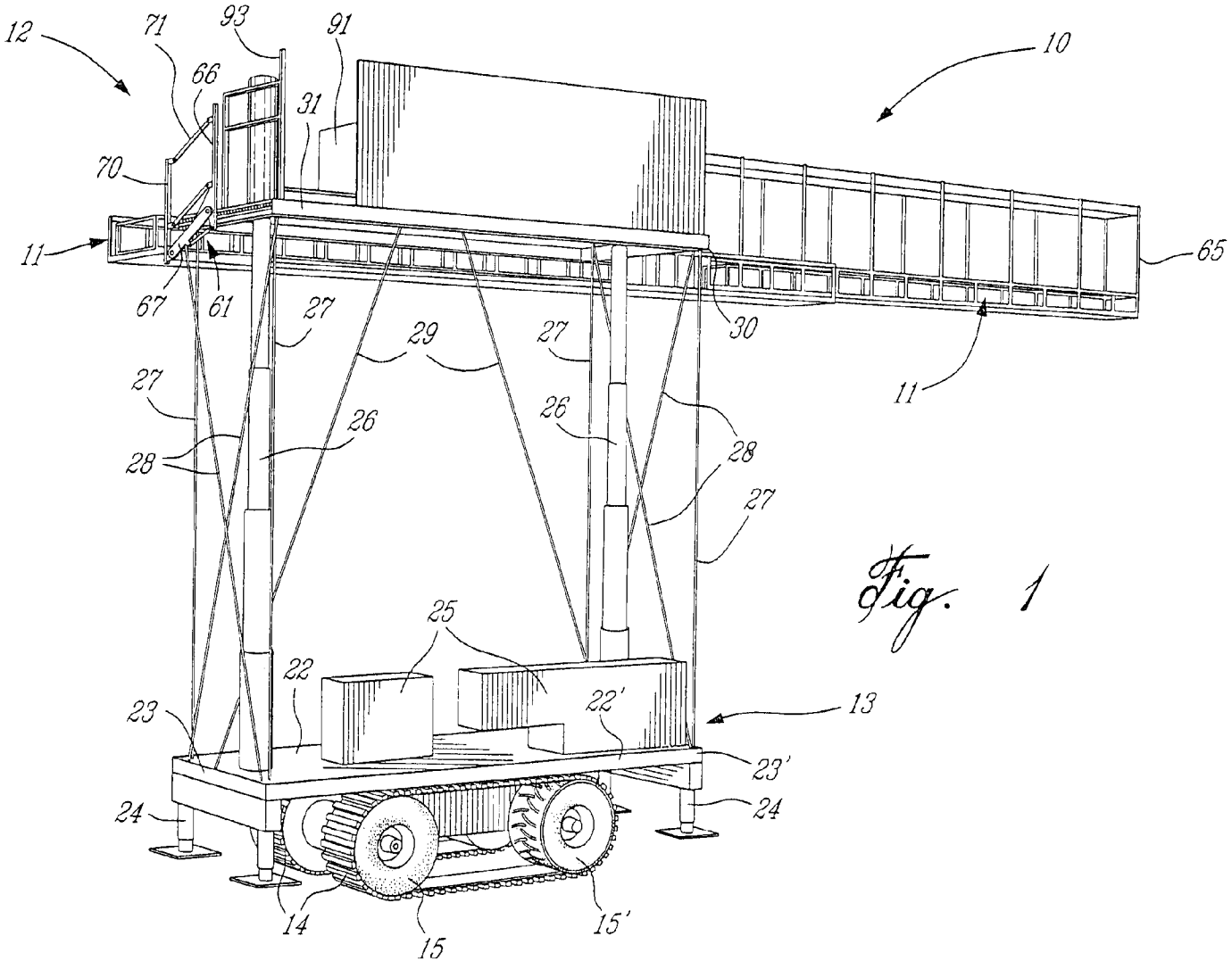
FIG. 1 is a perspective view of the motorized scaffold with the displaceable worker support platform in a partly extended lateral position.
Figure 2:
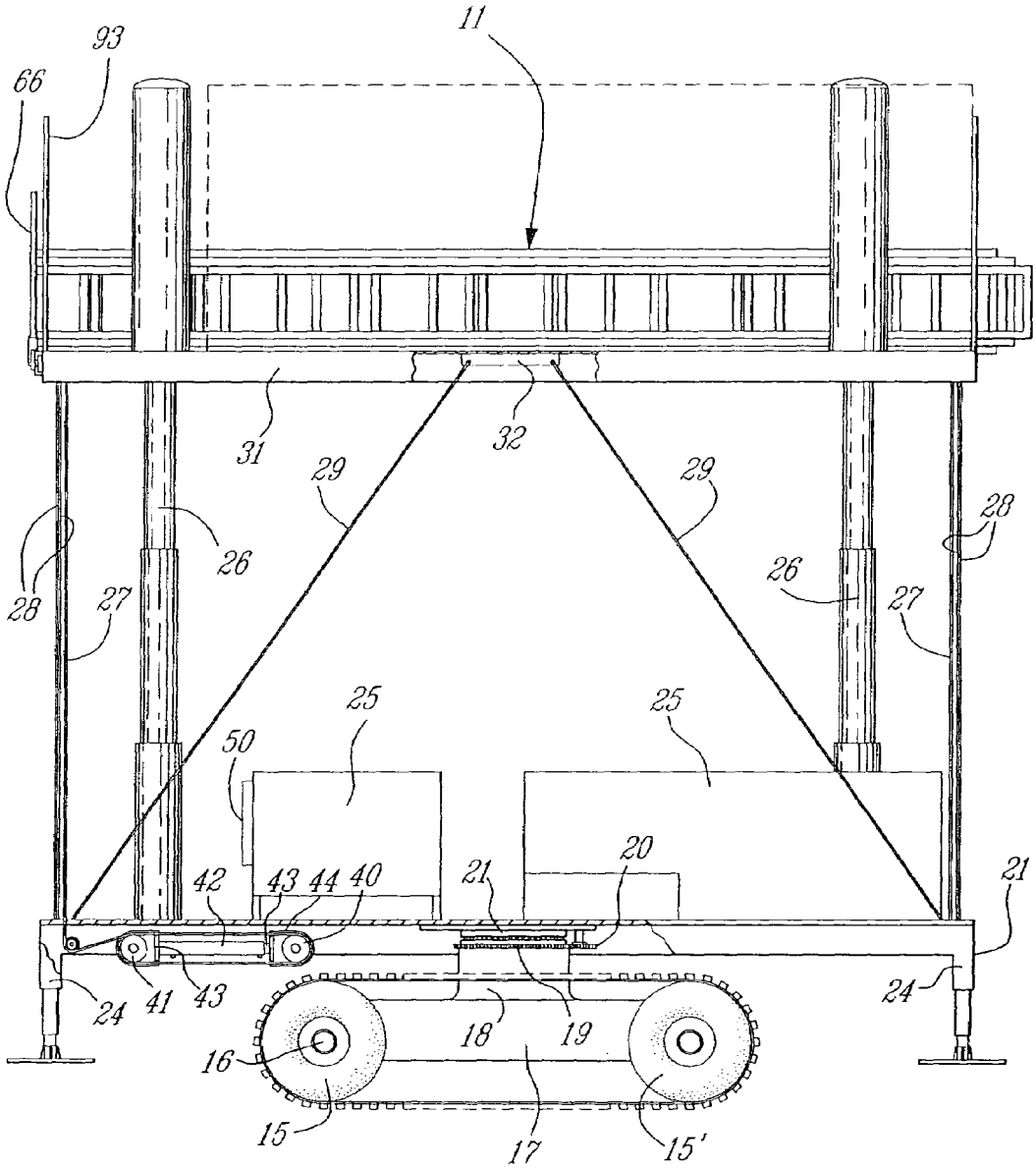
FIG. 2 is a side view of the motorized scaffold.
Figure 3:
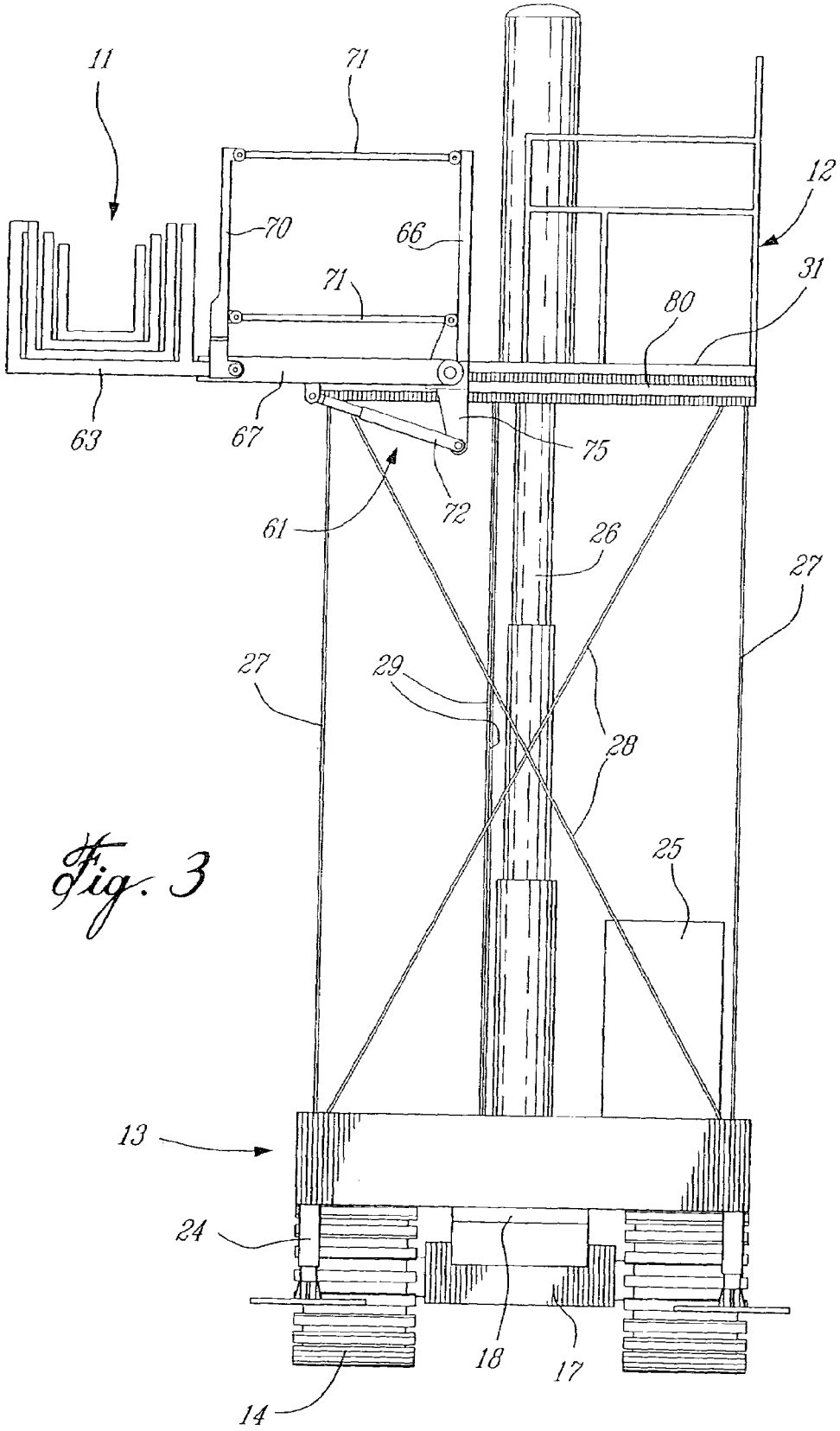
FIG. 3 is an end view of the motorized scaffold showing the displaceable worker support platform in a partly extended forward position.
Figure 4:
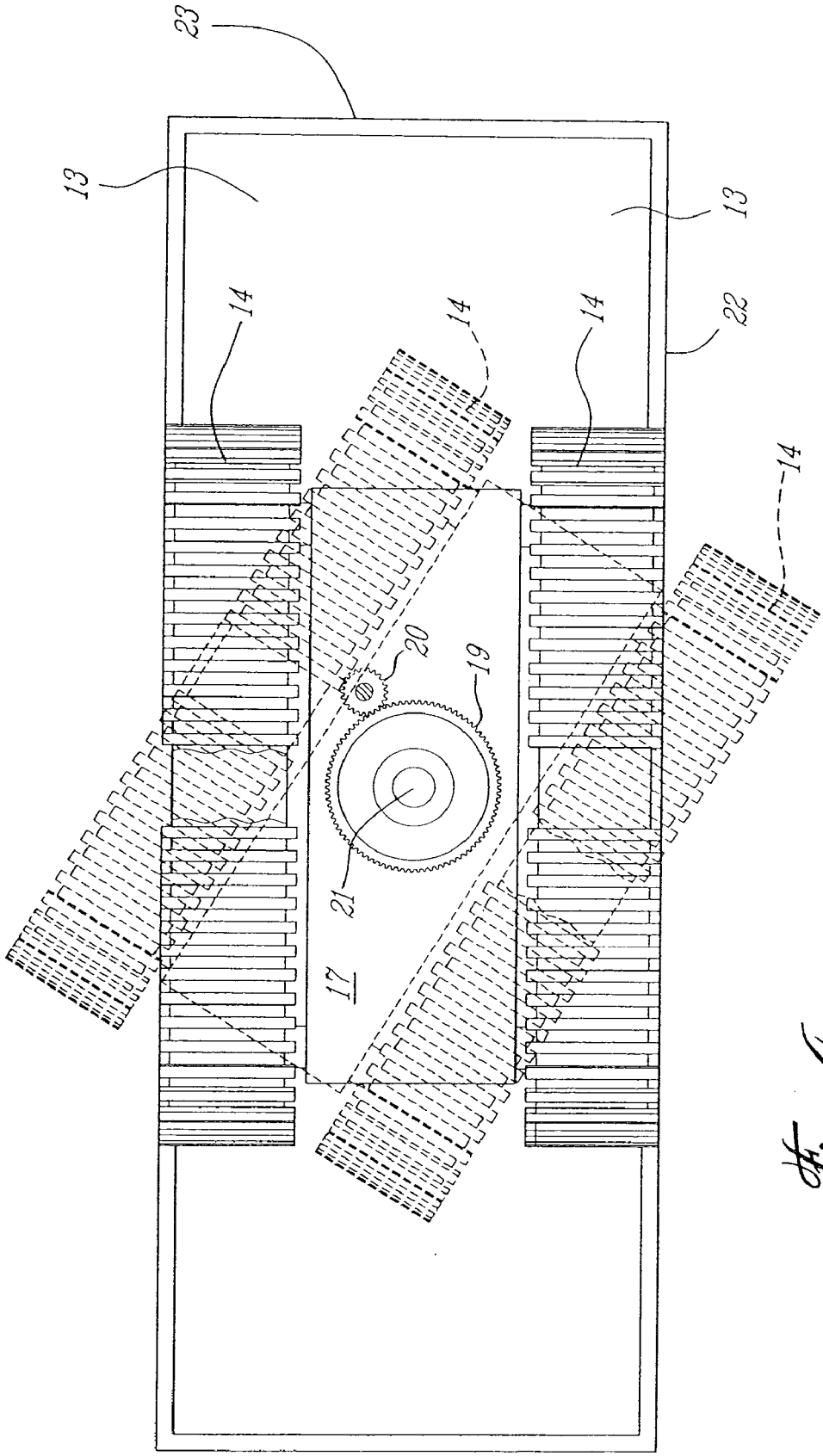
FIG. 4 is a bottom view of the motorized scaffold showing how the tracks are displaceable with respect to the support base.

Referring now to the drawings and more particularly to FIG. 1 there is showing generally at 10 the motorized scaffold of the present invention and which is equipped with a displaceable worker support platform 11. The worker support platform 11 forms part of a platform assembly 12 which is displaceably secured to a motorized support base 13. The motorized support base is provided with traction means in the form of a pair of ground engaging endless traction belts 14 each of which is trained between and about the pair of wheels 15 provided with traction tires 15' on opposed sides of the base 13. As shown in FIG. 2 the wheels 15 are secured to respective axels 16 mounted on an undercarriage 17 which is secured to a large pinion 18 provided with a circumferential gear 19. A pinion gear 20 is motor driven whereby to displace the undercarriage 17 and its wheels 15 on a pivot connection 21. Accordingly, the undercarriage 17 can pivot 360 degrees with respect to the support base 13 whereby to position the support base at a desired location as will be described later.

The motorized support base 13 is a substantially rectangular base which defines opposed elongated parallel edges 22 and 22' and opposed transverse end edges 23 and 23'. The motorized support base 13 is immobilized at a desired location and leveled by four hydraulic jacks 24 which are secured to a respective corner of the support base 13. The support base 13 also houses control and oil pressure equipment as well as an oil pressure reservoir in the different housings 25 herein schematically illustrated. As herein shown the platform assembly 12 is secured to the support base 13 by extendable support means which is constituted by a pair of large hydraulic cylinders 26.

An important aspect of the motorized scaffold of the present invention is that the platform assembly 20 is also secured to the support base 13 by displaceable bracing means in the form of various steel cables, as will be described in detail herein below, whereby to maintain the platform assembly 12 substantially stable during displacement thereof and when disposed at a stationary desired working elevation with respect to the support base 13. These bracing cables comprise corner bracing cables 27, cross cables 28, and a pair of lateral bracing cables 29. The corner bracing cables 27 are immovably secured at a connection 30 located in respective lower corner of the platform assembly and more specifically to the vertical material support and work area platform 31 thereof. The cross cables 28 are also secured to the connections 30 and crisscross each other in a vertical plane aligned with the end edges 23 of the support base. The lateral bracing cables are secured at a top end to a bracket or directly to the platform 31 as illustrated at reference numeral 32 in FIG. 2 and in a central area of the platform 31.

Figure 5:
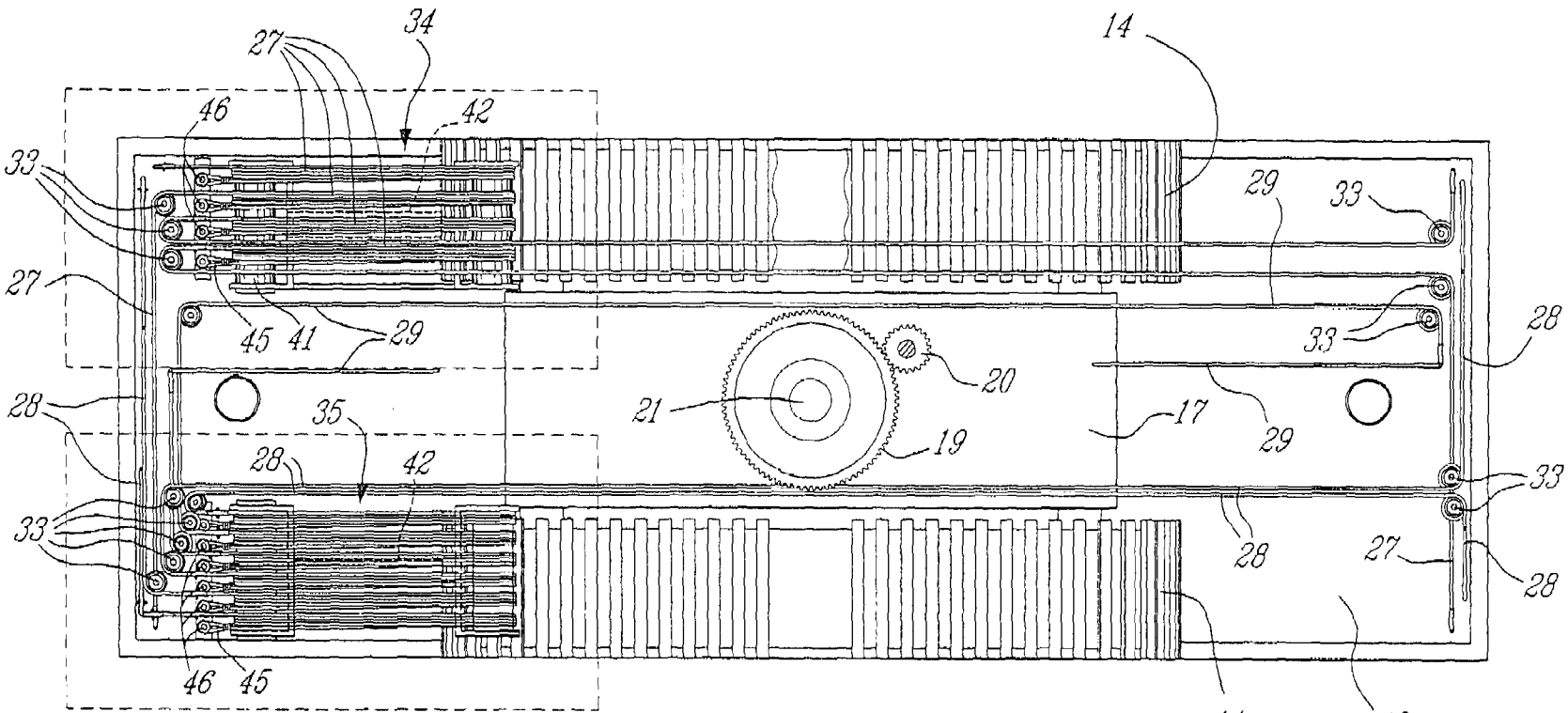
FIG. 5 is a partly fragmented bottom view of the support base showing the two variable size storage cable loop mechanisms.
Figure 6A:
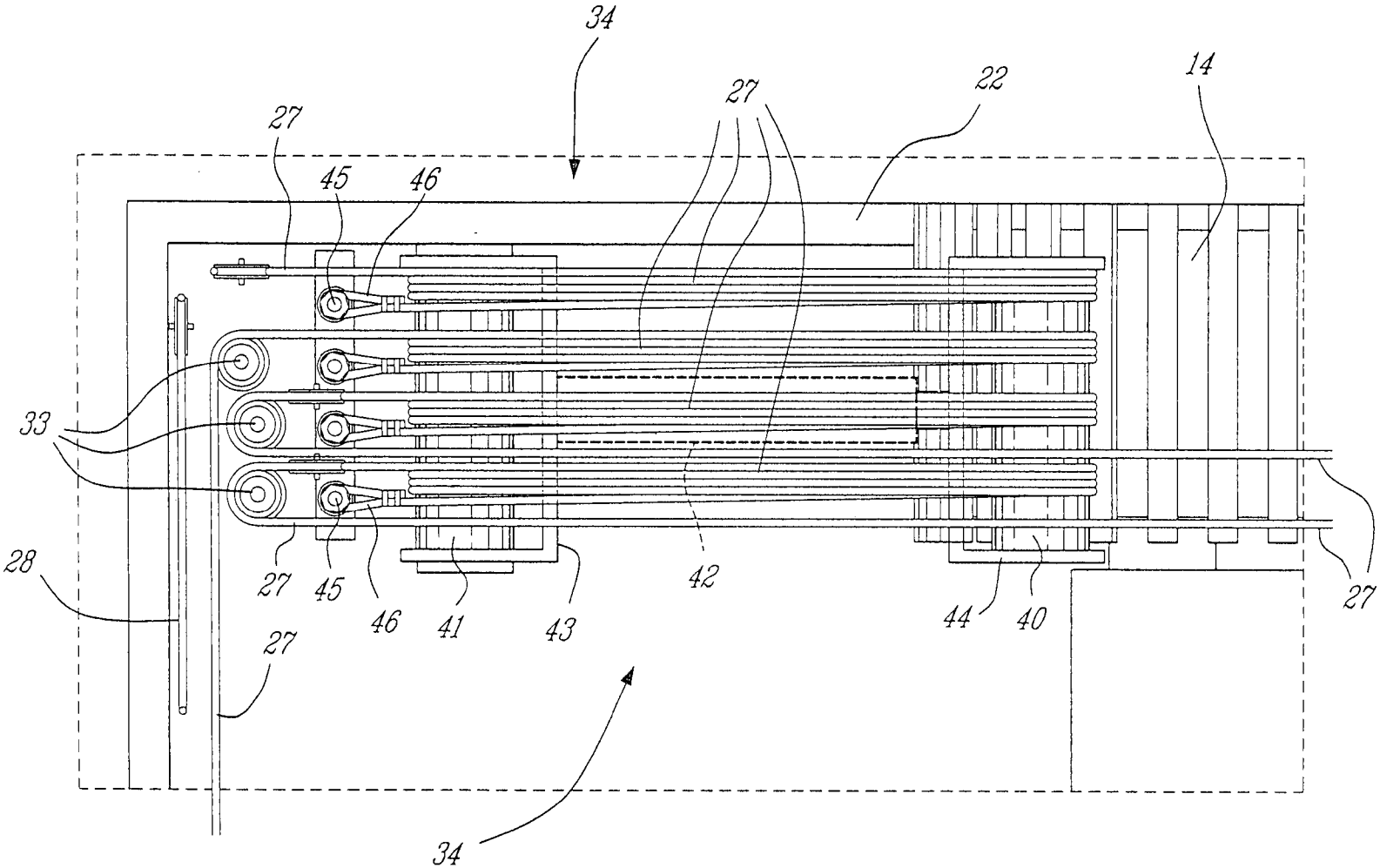
FIGS. 6A and 6B are enlarged views of the variable size storage cable loop mechanisms with the cable loops fully wound and the platform assembly fully retracted.
Figure 6B:
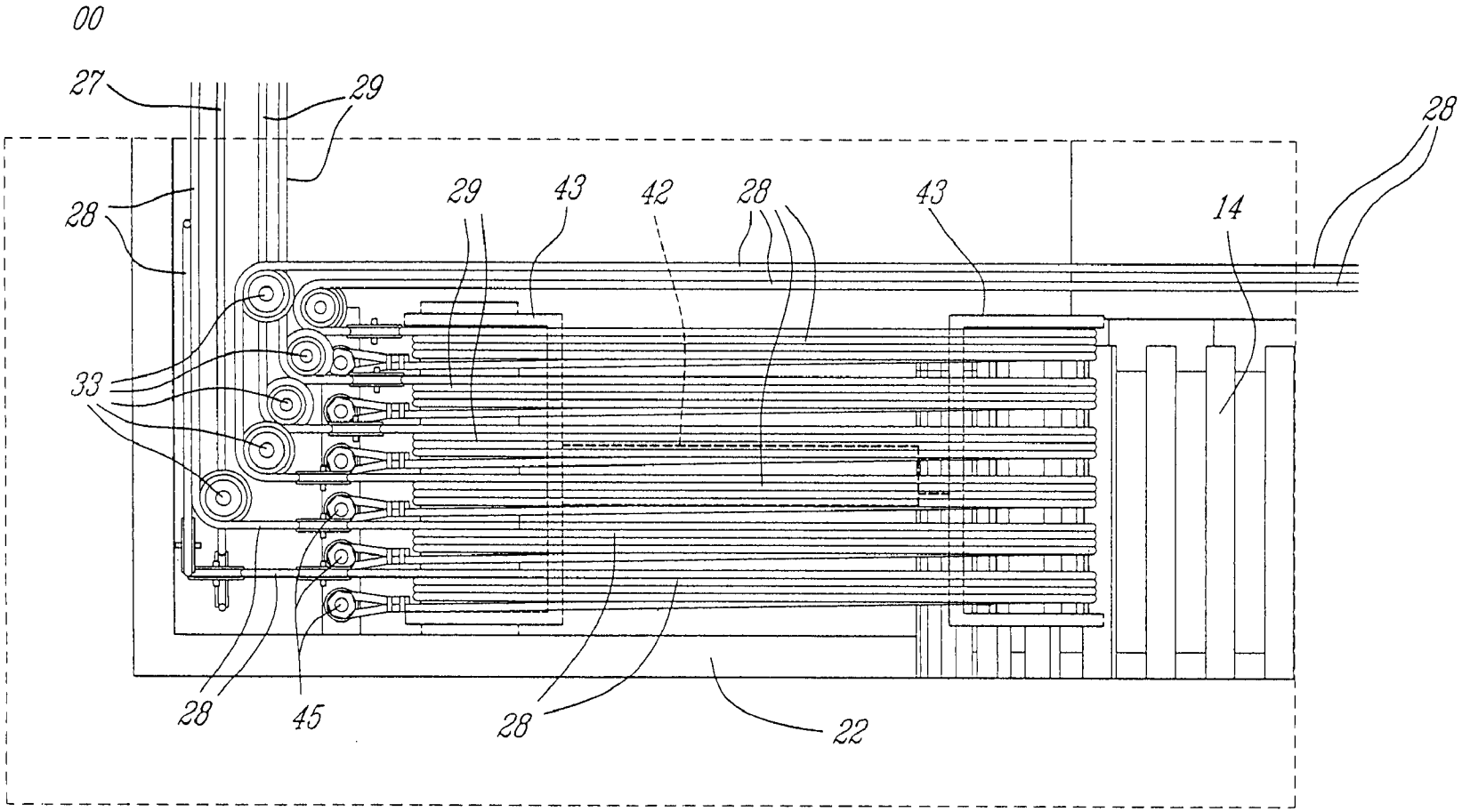

With reference now to FIGS. 2, 5, 6 and 7 it can be seen that the bracing cables are each guided by guide pulleys 33, only a few shown herein, for winding a predetermined length of each of these cables upon winding means in the form of variable size storage cable loop mechanisms 34 and 35 as clearly illustrated in FIGS. 5, 6A and 6B. One of the loop mechanisms, herein loop 34 is provided to store a predetermined length of cables of the four corner bracing cables 27, whereas the other cable loop mechanisms 35 stores a quantity of cable for the cross cables 28 and the lateral bracing cables 29. These variable size storage cable loop mechanisms maintain the cables taut during displacement of the platform assembly 12 as it moves up and down with respect to the support base 13 and also while the platform assembly 12 is stationary at a desired working elevation.

Figure 7:
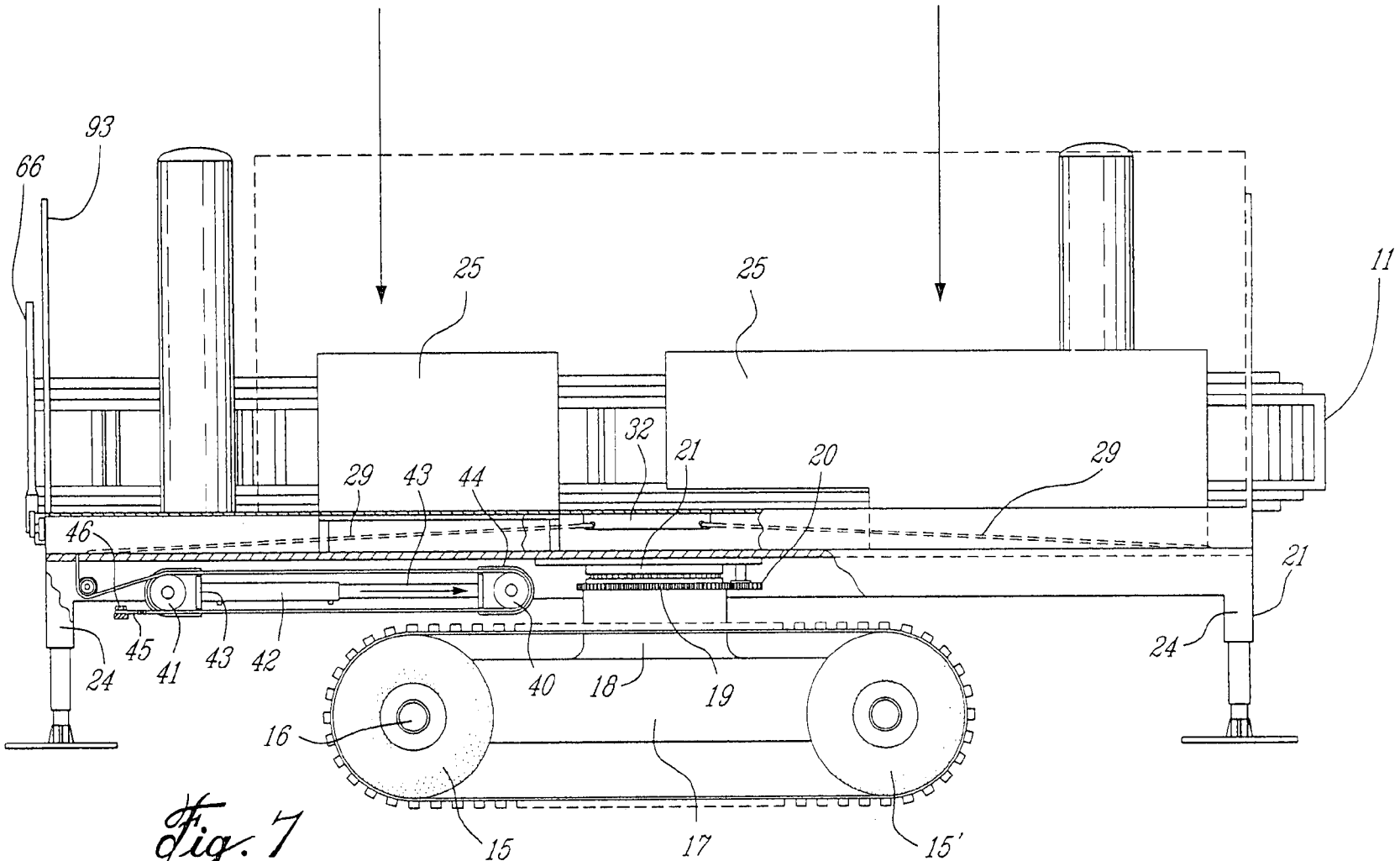
FIG. 7 is a simplified side view of the motorized scaffold showing the position of the variable size storage cable loop mechanisms with the displaceable spool in its extended position and the platform assembly fully lowered.

As shown in FIGS. 6 and 7 the variable size storage cable loop mechanisms 34 are provided by a pair of cable guiding spools 40 and 41 with spool 40 being displaceable with respect to spool 41 which is a stationary spool. A piston cylinder 42 is immovably secured to a frame 43 and has its piston shaft 43 secured to a displaceable frame 44 which supports the displaceable spool 40. A length of cable, for example cable 27 is guided about guide pulleys 33 and wound between the spools 40 and 41 and immovably secured at a terminal end 45 to a connector 46. The piston cylinder 42 applies a force against displaceable spool 40 to keep the cables 27 wound taut about these spools. The pressure in the piston cylinder 42 is inferior to the pressure in the hydraulic cylinder 26. Accordingly, as the hydraulic cylinders 26 displace the platform assembly 12 they override the pressure in these piston cylinders 42 but the cables are always maintained taut. This is the same for all bracing cables.

As shown in FIG. 1 the piston cylinders 42 are connected to a control valve 47 which interconnects the oil pressure supply 48 to the hydraulic cylinders 26. The oil pressure in the cylinders 42 is maintained at a lower pressure than that of the extendable cylinders 26 as previously described. In the event that there was a loss of pressure in the pressure cylinders 42, then this would cause the control valve 47 to close to immobilize the extendable cylinders 26 whereby to arrest the platform assembly 12. This valve provides a safety feature for the motorized scaffold to insure that the platform assembly 12 is always well braced. As shown the corner bracing cables extend along a respective vertical guide path and about guide pulleys. The cross cables 28 extend along diagonal guide paths between opposed ends of the platform assembly 12 and corner areas of the support base 13. The lateral bracing cables 29 extend along angular guide paths to opposed ends of the support base at substantially mid-length thereof and about these guide pulleys 33 to be wound on its associated variable size storage cable loop mechanism 35.

Figure 8:
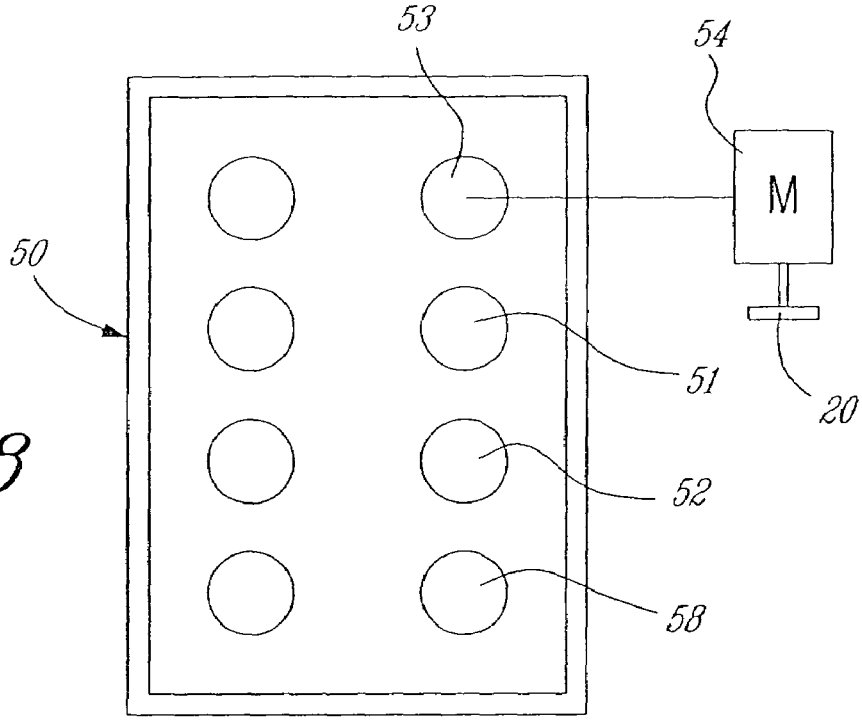
FIG. 8 is a front view of the control panel.
Figure 9:
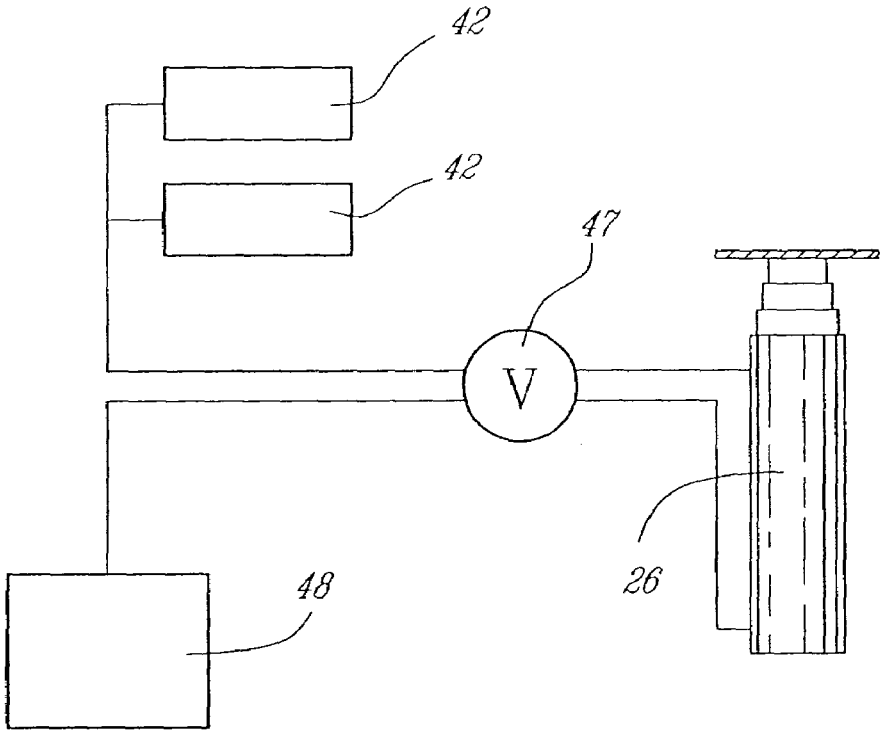
FIG. 9 is a simplified schematic diagram showing the interconnection of the pressure biasing cylinders of the variable size storage cable loop mechanisms with the extendable cylinders of the worker support platform and the oil pressure supply through a control valve.
Figure 10:
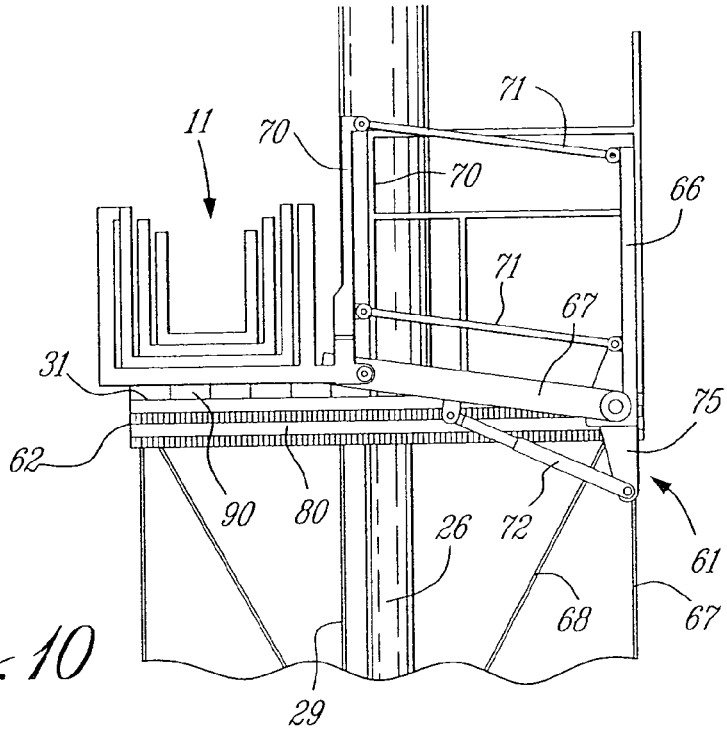
FIG. 10 is a partly fragmented side view showing the displaceable worker support platform in a retracted position over the platform assembly.
Figure 13:
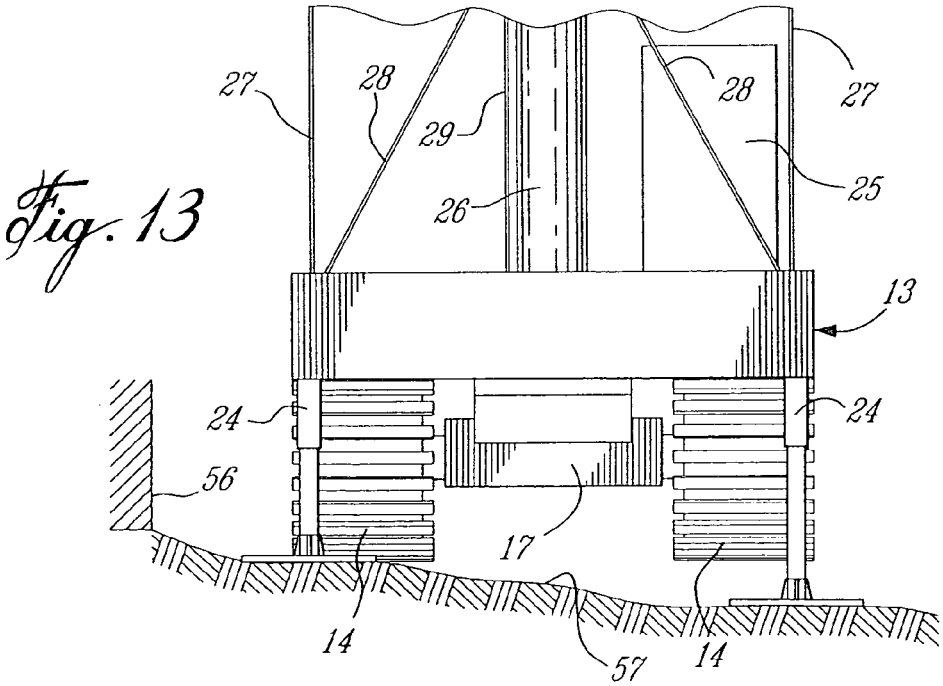
FIG. 13 is a simplified view showing the motorized scaffold support base engaged with a sloped ground surface adjacent a wall where the worker support platform is to be displaced and with the hydraulic jacks in position and engagement with the ground surface.

A control panel 50, as illustrated in FIG. 8 and is provided with switch means or other type of controls to operate the vehicle traction belts, the jacks, and the different cylinders, etc. It is provided with two controls namely controls 51 and 52 to operate the traction belts 14 whereby to make the vehicle move forwardly, rearwardly or to pivot. Pivoting is obtained by causing the belts to rotate in opposite directions. Switch 53 is provided to operate a motor 54 which operates the pinion gear 20 to cause the support base 13 to pivot. Each hydraulic jack 24 is operated by respective one of the switches 55 to level the base. As shown in FIG. 13, if it is necessary to position the work support platform 11 adjacent a vertical wall 56 on which work is to be done, then the motorized support base 13 is disposed on the ground surface 57 at a location spaced from the wall 56. However, seeing that the ground surface 57 is sloped the support base 13 would be angulated with respect to the wall. By operating each of the hydraulic jacks 24 independently the support base 13 can be substantially leveled as herein shown. However, before doing so the support base 13 is rotated over the traction belts to position it substantially parallel to the wall 56. Switch 58 of the control panel operates the hydraulic cylinders 26 to move the platform assembly 12 up or down.

Figure 11:
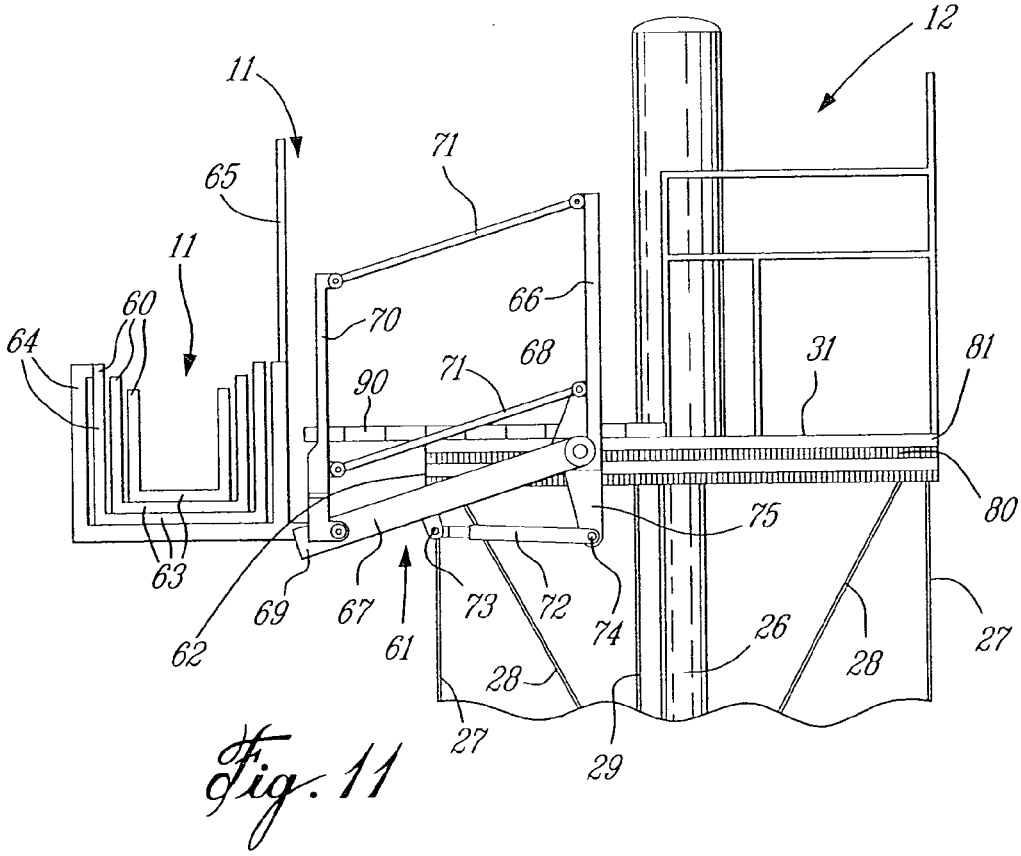
FIG. 11 is a view similar to FIG. 10 but showing the worker support platform in a partly extended forward position and lowered from the material storage and work area platform.
Figure 12:
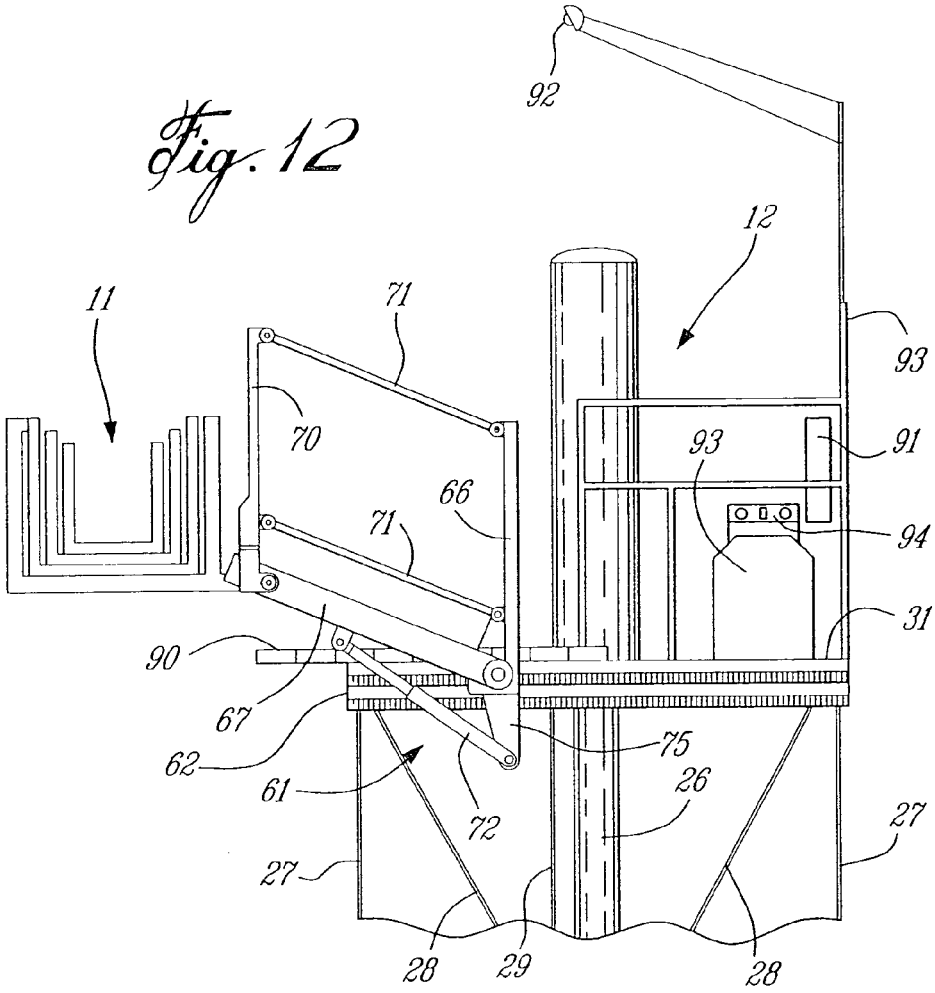
FIG. 12 is a view similar to FIG. 11 but showing the worker support platform elevated from the material support and work area platform.

Referring now to FIGS. 3, and 10 to 12, there will be described the construction and operation of the worker support platform assembly 11. As herein shown the worker support platform assembly 11 consists of two or more elongated rectangular frames 60 being slidingly and telescopically interconnected together, one inside the other, like a fire engine extendable ladder and being extendable along its longitudinal axis by interconnection means such as a pulley and cable mechanism or a rack and pinion mechanism. Thus, the worker support platform 11 can be extended laterally, as shown in FIG. 1, adjacent any one of opposed end edges of the material support and work area platform 31. This worker support platform 11 is secured to an articulated support frame 61 which is itself secured to the platform assembly 12 and more particularly to the material support and work area platform 31 which is a rectangular floor structure. As shown in FIGS. 11 and 12 the articulated support frame 61 permits the displacement of the work support platform 11 downwardly or upwardly from a longitudinal edge 62 of the platform 31. An articulated support frame 61 is provided on both sides of the platform 31. The worker support platform 11 has floor support braces 63 and opposed vertical connecting arms 64 for each section thereof. Safety posts and ropes 65 may be removably connected to the top edge of each of the vertical connecting arm 64 to provide security to workers. The articulated support frame 61 is provided with a vertical connecting post secured to opposed sides of the platform 31. A pivotal support arm 67 is connected at one end to a lower end 66' of an associated one of the vertical connecting post 66 by a pivot connection 68, and at an opposed end 69 to a vertical connecting arm 70 which is pivotally secured to an outer one of the worker support platform telescoping frames 63. A pair of link rods 71 are pivotally connected between the vertical connecting post 66 and a vertical connecting arm 70 and disposed parallel to the pivotal support arm 67 and to each other. A piston cylinder 72 is pivotally connected at a piston rod end 73 to the pivotal support arm 67 and at a piston cylinder end 74 to a lower extension portion 75 of the vertical connecting post 66. There is of course a piston on opposed sides associated with respective one of the articulated support frame 61. Each of these pistons 72 is actuated in tandem to displace the outermost floor support brace 63, and consequently all of the other floor support braces 63, in a substantially horizontal plane upwardly and downwardly from the longitudinal front edge 62 of the platform 31.

As can be seen from FIGS. 3, and 10 to 12 the platform 31 is provided with a guide track 80 on opposed straight vertical end walls thereof. The vertical connecting post 66 is connected to a respective one of the guide tracks 80 and displaceable there along by displacement means which could be in the form of a motor and gear, pistons, or pulleys and cables, for example. Accordingly, the worker support platform 11 can be displaced to and away from the longitudinal front edge 62 of the platform 31 to position it adjacent a working surface such as the wall 56 illustrated in FIG. 13. The work support platform is also extendable laterally from opposed end walls 51 of the platform 31. Accordingly, workers can be supported and positioned adjacent very large working areas without having to displace the motorized support base. Also, as illustrated in FIG. 1 by providing a laterally extendable work support platform 11 workers can be supported in tight or narrow areas, such as between adjacent building structures where a corridor may be only 4 to 6 feet wide. It would not be possible to position the vehicle or base in such tight areas. Further, the articulated support frame 61 permits workers to be positioned at different heights with respect to the platform 31 without having to displace the platform assembly 12 each time the height varies by approximately four feet. Controls, not shown are also provided on the platform assembly to displace the worker support platform and to raise and lower the platform assembly 12. As shown in FIGS. 11 and 12 a bridge floor 90 is extendable to bridge the gap between the platform 31 and the worker support platform 11 when it is extended outwardly from the longitudinal edge 62 of the platform 31 whereby to provide added security to the workers.

As shown in FIG. 12 the work area platform 31 may also be provided with tools 91 such as metal bending tools so that workers have direct access to the tools at the work station. A retractable canopy 92 may also be connected to the frame work 93 of the platform 31 to permit work during inclement weather conditions. The work area platform 31 may also be provided with a compressor 93 and an electrical supply terminal 94 for operating hand operable tools.

It is within the ambit of the present invention to cover any obvious modifications of the preferred embodiment described herein, provided such modifications fall within the scope of the appended claims.

I claim:

1. A motorized scaffold for self-displacement on land, said scaffold comprising a motorized support base mounted on traction means for displacement on land, means to immobilize and level said support base at a desired location, a platform assembly secured over said support base on extendable support means, displaceable bracing means secured between said support base and said platform assembly to maintain said platform assembly substantially stable during displacement thereof and at a stationary desired working elevation with respect to said support base, and a displaceable worker support platform secured to said platform assembly for supporting workers thereon, said displaceable bracing means being constituted by bracing cables secured at one end to said platform assembly and at an opposed end to cable winding means secured to said support base to maintain said cables taut during displacement of said platform assembly and while said platform assembly is stationary at said desired working elevation, said bracing cables being wound about a variable size storage cable loop mechanism of said cable winding means, said cable loop being formed by guiding windings of said cable loop between a pair of parallel mounted cable support spools, one of said spools being a displaceable spool and the other a stationary spool, said displaceable spool being secured to pressure biasing means, a terminal end of said bracing cables being immovably secured to said support base.

2. A motorized scaffold as claimed in claim 1 wherein said pressure biasing means is a piston cylinder which applies a pressure against said displaceable spool, said pressure being inferior to the pressure of extendable cylinders constituting said extendable support means.

3. A motorized scaffold as claimed in claim 2 wherein said bracing cables comprise vertical corner bracing cables, said platform assembly having a rectangular support frame, said corner bracing cables being secured to a respective corner of said rectangular support frame and depending from and along a vertical guide path and about guide pulleys to align said bracing cables with a respective one of four cable loops wound about said spools.

4. A motorized scaffold as claimed in claim 3 wherein said bracing cables further comprise cross-cables, each said cross-cables being secured to a respective one of said corners of said rectangular support frame, said support base being a rectangular support base, said platform assembly being supported in substantially parallel planar alignment with said support base, said cross-cables extending along a diagonal guide path between opposed ends of said support base and said rectangular support frame by guide pulleys and being wound with a respective one of four cable loops wound about said spools of a second one of said variable size storage cable loop of said cable winding means.

5. A motorized scaffold as claimed in claim 4 wherein said bracing cables further comprise a pair of lateral bracing cables, each cable of said pair being secured to said rectangular support frame in a central area thereof and guided thereunder by pulleys along an angular guide path extending to opposed ends of said support base at substantially mid-length thereof and wound about a respective cable loop wound about said spools of said second one of said variable size storage cable loop of said cable winding means.

6. A motorized scaffold as claimed in claim 2 wherein said piston has an oil pressure conduit connected to a control valve, said extendible cylinders having oil pressure conduits also connected to said control valve and to an oil pressure supply, said pressure in said conduit connected to said piston when falling to a predetermined pressure value causing said control valve to close to arrest said extendable hydraulic cylinders.

7. A motorized scaffold as claimed in claim 1 wherein said displaceable worker support platform is a laterally extendable worker support platform.

8. A motorized scaffold as claimed in claim 7 wherein said worker support platform is secured to an articulated support frame secured to said platform assembly.

9. A motorized scaffold as claimed in claim 8 wherein said platform assembly further comprises a material storage and work area defined by a support rectangular floor structure, said articulated support frame permitting displacement of said worker support platform upwardly and downwardly from a longitudinal front edge of said floor structure.

10. A motorized scaffold as claimed in claim 9 wherein said articulated support frame is provided on opposed sides of said rectangular floor, said worker support platform being an elongated rectangular platform having floor support braces and opposed vertical connecting arms, said articulated support frame having a vertical connecting post secured to opposed sides of said floor structure, a pivotal support arm pivotally connected at one end to a lower end of an associated one of said vertical connecting posts and at an opposed end to an associated one of a vertical connecting arm pivotally connected to an outermost one of said worker support platform telescoping frames, and a links rod also pivotally connected between said vertical connecting post and said vertical connecting arm and disposed parallel to said pivotal support arm, and a piston cylinder pivotally connected at a piston rod end to said pivotal support arm and at a piston cylinder end to said vertical connecting post, said pistons being actuated in tandem to displace said outmost floor support brace upwardly and downwardly from said longitudinal edge of said floor structure while maintaining said worker support platform horizontal.

11. A motorized scaffold as claimed in claim 8 wherein said articulated support fare is displaceably secured to said platform assembly.

12. A motorized scaffold as claimed in claim 11 wherein said articulated support frame is provided on opposed sides of said rectangular floor, said opposed sides being provided with guide tracks, each said articulated support frame having a connecting post mounted on a respective one of said guide tracks, and means to displace and arrest said connecting post along said guide track to position said worker support platform to and away from a longitudinal front edge of said rectangular floor and at a retracted position over a portion of said rectangular floor.

13. A motorized scaffold as claimed in claim 12 wherein there is further provided a bridge floor slidingly and extendable from said longitudinal edge of said rectangular floor.

14. A motorized scaffold as claimed in claim 7 wherein said worker support platform is comprised of elongated telescoping rectangular frames, each frame having a floor to support workers, said telescoping frames being extendable from opposed ends of said worker support platform, said telescoping frames and a load thereon being counter-balanced by said bracing means.

15. A motorized scaffold as claimed in claim 9 wherein said material storage and work area is provided with a retractable canopy displaceably secured thereabove to shield worker from inclement weather conditions.

16. A motorized scaffold as claimed in claim 1 wherein said traction means is secured to said support base by a swivel connection whereby said support base can be positioned at a desired angle with respect to said traction means.

17. A motorized scaffold as claimed in claim 16 wherein said swivel connection is a circular disc gear connected to a pinion gear rotatable by a drive motor.

18. A motorized scaffold as claimed in claim 16 wherein said traction means is constituted by a pair of ground engaging endless traction belts each trained between and about a pair of wheels.

19. A motorized, scaffold as claimed in claim 1 wherein said means to immobilize and level said support base is constituted by four hydraulic jacks secured to a respective corner of said support base, said support base being a rectangular support base.

20. A motorized scaffold as claimed in claim 19 wherein a control panel is accessible from a drive station of said support base when said platform assembly is at a lowered position to displace said scaffold on land and to operate said hydraulic jacks and extendable support means.

21. A motorized scaffold as claimed in claim 20 wherein a further control panel is accessible from said platform assembly to operate said displaceable worker support platform and said extendable support means.

22. A motorized scaffold as claimed in claim 9 wherein there is further provided a compressor and electrical supply at said work area for operating hand operable tools and material working machinery.

* * * * *